US012575621B2

(12) United States Patent
Allison

(10) Patent No.: US 12,575,621 B2
(45) Date of Patent: Mar. 17, 2026

(54) NECK GAITER

(71) Applicant: Milk Run Moto, LLC, Arlington, WA (US)

(72) Inventor: Anastasia Allison, Arlington, WA (US)

(73) Assignee: Milk Run Moto, LLC, Arlington, WA (US)

( * ) Notice: Subject to any disclaimer, the term of this patent is extended or adjusted under 35 U.S.C. 154(b) by 0 days.

(21) Appl. No.: 18/676,024

(22) Filed: May 28, 2024

(65) Prior Publication Data

US 2025/0009050 A1 Jan. 9, 2025

Related U.S. Application Data

(60) Provisional application No. 63/512,221, filed on Jul. 6, 2023.

(51) Int. Cl.
*A41D 13/05* (2006.01)

(52) U.S. Cl.
CPC ..... *A41D 13/0512* (2013.01)

(58) Field of Classification Search
CPC ..... A41D 13/0512; A41D 13/1153; A41D 23/00; A42B 1/046; A42B 1/0187; A42B 3/18; A42B 3/105
USPC ..... 2/206, 468
See application file for complete search history.

(56) References Cited

U.S. PATENT DOCUMENTS 1,309,783 A * 7/1919 Slawin ..... A41D 13/11 2/206
2,546,117 A * 3/1951 Whelan ..... A45D 44/12 D29/106
2,567,192 A * 9/1951 De Grazia ..... A42B 1/046 2/205
3,337,877 A * 8/1967 Sol ..... A42B 1/22 2/172
4,573,217 A * 3/1986 Reed ..... A62B 17/04 2/205
4,602,385 A * 7/1986 Warren ..... A41D 13/0518 2/92
5,007,115 A * 4/1991 Denbow ..... A41D 23/00 2/202
5,799,334 A * 9/1998 Griffith ..... A42B 1/225 2/195.1
5,822,800 A * 10/1998 Anderson ..... A42B 1/06 2/202
5,881,389 A * 3/1999 Fruge ..... A42B 1/046 2/202

(Continued)

FOREIGN PATENT DOCUMENTS

DE 29509261 U1 * 8/1995 ..... A42B 1/046
DE 202016000324 U1 * 3/2016 ..... A42B 1/046

(Continued)

*Primary Examiner* — Grace Huang
(74) *Attorney, Agent, or Firm* — Gordon Rees Scully & Mansukhani, LLP

(57) ABSTRACT

A neck gaiter, comprising a main body, a plurality of openings within the main body, and a plurality of flaps. Each flap is partially secured to the main body and covers one of the plurality of openings. The openings and flaps are configured to receive a portion of a user's hair. Each of the plurality of flaps is configured to secure the hair against a portion of a user's body and substantially prevent wind from entering the main body through a respective opening.

9 Claims, 5 Drawing Sheets

(56) References Cited

U.S. PATENT DOCUMENTS 6,665,881 B2 * 12/2003 Giggleman ..... A42B 1/241 2/202
8,689,362 B2 * 4/2014 Lavin ..... A41D 13/0512 2/468
9,491,979 B2 * 11/2016 Kim ..... A42B 7/00
9,510,629 B2 * 12/2016 Lause ..... A42B 1/225
9,826,787 B2 * 11/2017 Wu ..... A42B 1/006
12,053,044 B2 * 8/2024 Carey ..... A42B 1/205
2006/0137072 A1 * 6/2006 Visco ..... A41D 23/00 2/127
2008/0092272 A1 * 4/2008 Vainio ..... A42B 1/225 2/209.3
2009/0083898 A1 * 4/2009 Shirey ..... A42B 1/225 2/209.3
2009/0089916 A1 * 4/2009 Leftenant ..... A42B 1/041 2/207
2009/0178176 A1 * 7/2009 Rowe ..... A42B 1/048 2/202
2009/0255030 A1 * 10/2009 Guy ..... A42B 1/225 2/195.3
2014/0082826 A1 * 3/2014 Kuthari ..... A42B 1/225 2/171.7
2019/0075874 A1 * 3/2019 Smith, Sr. ..... A42B 1/225
2019/0090561 A1 * 3/2019 Brandt ..... A42B 1/046
2019/0110534 A1 * 4/2019 Carter ..... A41D 20/00
2021/0337894 A1 * 11/2021 Polley-Hoffman ..... A41D 13/1107
2022/0312878 A1 * 10/2022 Clark ..... A41G 5/0093
2025/0031782 A1 * 1/2025 Lambert ..... A41D 13/1107

FOREIGN PATENT DOCUMENTS

KR 200460168 Y1 * 5/2012 ..... A42B 1/04
KR 20130039840 A * 4/2013 ..... A41B 13/1153
WO WO-03026451 A2 * 4/2003 ..... A42B 1/225

* cited by examiner

NECK GAITER

CROSS-REFERENCE TO RELATED APPLICATIONS

The present invention claims the benefit of priority to U.S. Provisional Application No. 63/512,221, filed Jul. 6, 2023, which is incorporation herein by reference in its entirety.

BACKGROUND OF THE INVENTION

Neck gaiters are commonly used to protect and/or insulate the neck of a wearer. Neck gaiters are primarily formed as tubes or wraps configured to fit loosely or snugly around a wearer's neck. These accessories are typically fairly simply constructed and are designed to either be pulled over the head of the wearer or wrapped and fastened in some manner. Gaiters may be worn in cold climates/seasons for insulation and warmth, in hot climates/seasons for protection from the sun, and/or during activities involving high speeds and/or open-air such as skiing or riding motorcycles, snow mobiles, all-terrain vehicles, and open-air jeeps, etc.

Some wearers of neck gaiters that participate in such open-air and/or high speed activities have hair that is secured either, for example, via a single braid, one or more braids, a ponytail, or multiple ponytails (also referred to as "pigtails"). Conventional neck gaiters are insufficient to secure these types of hair styles during such activities.

Improvements are needed.

SUMMARY OF THE INVENTION

The present disclosure relates to a neck gaiter, and methods of making a using a neck gaiter. The neck gaiter may include a main body. The main body may include one or more openings covered by flaps. The flaps may be partially secured to the main body. The openings may be configured to receive a braid or ponytail, and the flaps may secure the braid or ponytail against a portion of the wearer's body.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and the invention may admit to other equally effective embodiments.

Other features of the present embodiments will be apparent from the Detailed Description that follows.

DETAILED DESCRIPTION

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention. Mechanical and structural changes may be made to the embodiments without departing from the spirit and scope of the present teachings. The following detailed description is therefore not to be taken in a limiting sense, and the scope of the present disclosure is defined by the appended claims and their equivalents.

As illustrated in the accompanying Figures, the present disclosure relates to neck gaiters and methods of making and using neck gaiters. Neck gaiters according to embodiments of the disclosure may assist in keeping a wearer's hair in place, particularly when the hair is in a braid or ponytail.

Figure 2:
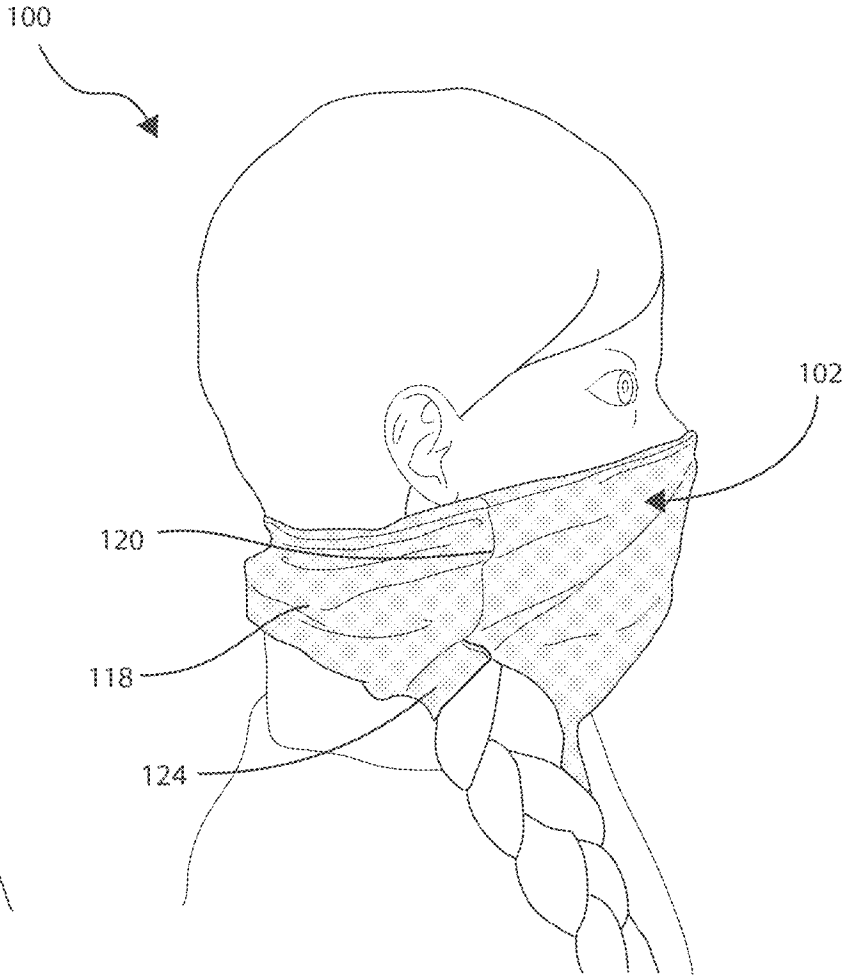
FIG. 2 is a side view illustration of a neck gaiter shown when worn according to embodiments of the disclosure.
Figure 1:
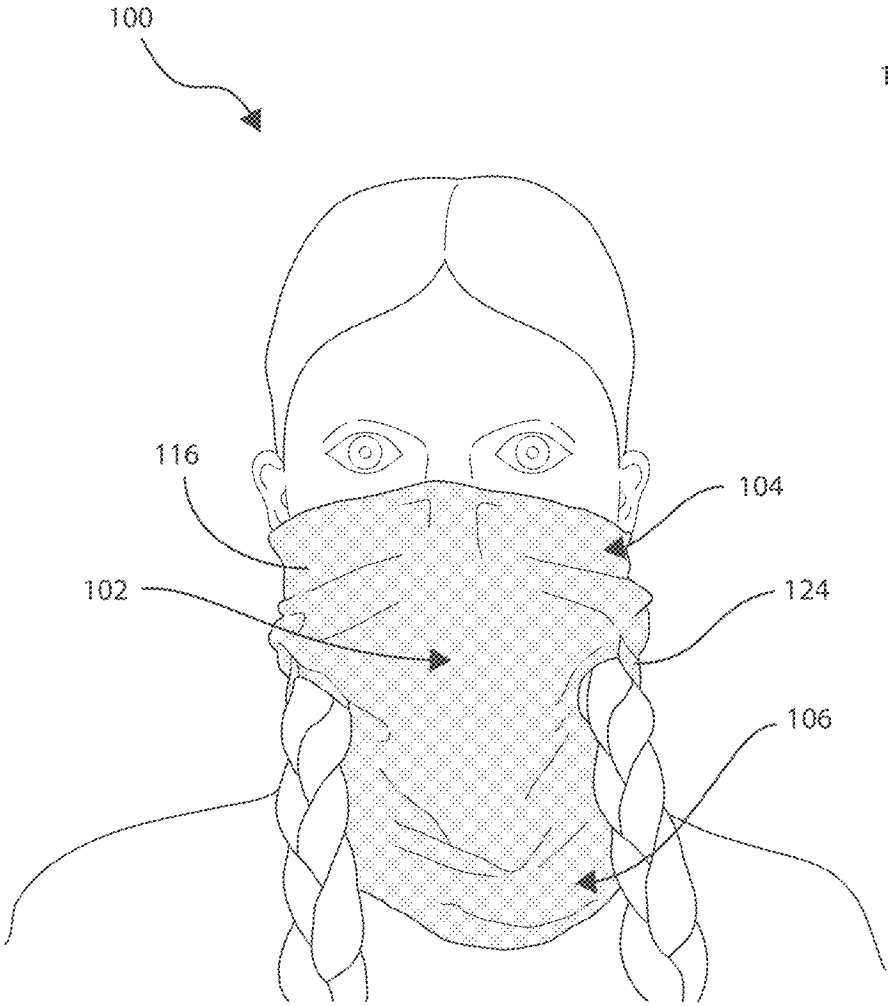
FIG. 1 is a front perspective view illustration of a neck gaiter shown when worn according to embodiments of the disclosure.
Figure 4:
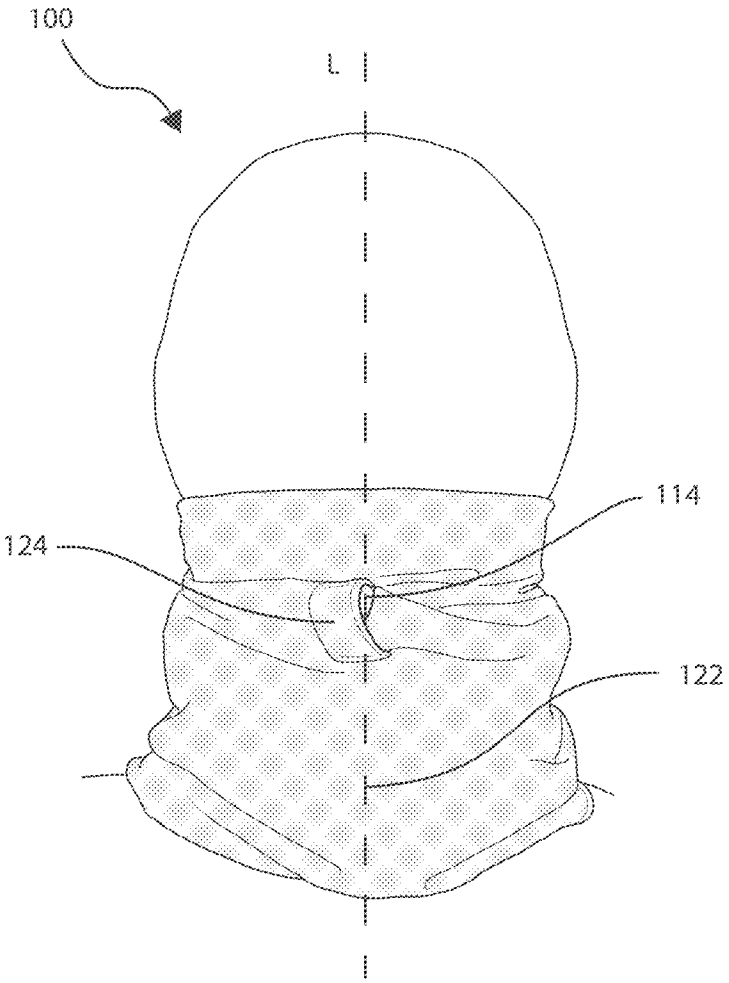
FIG. 4 is a back view illustration of a neck gaiter shown when worn according to embodiments of the disclosure.
Figure 3:
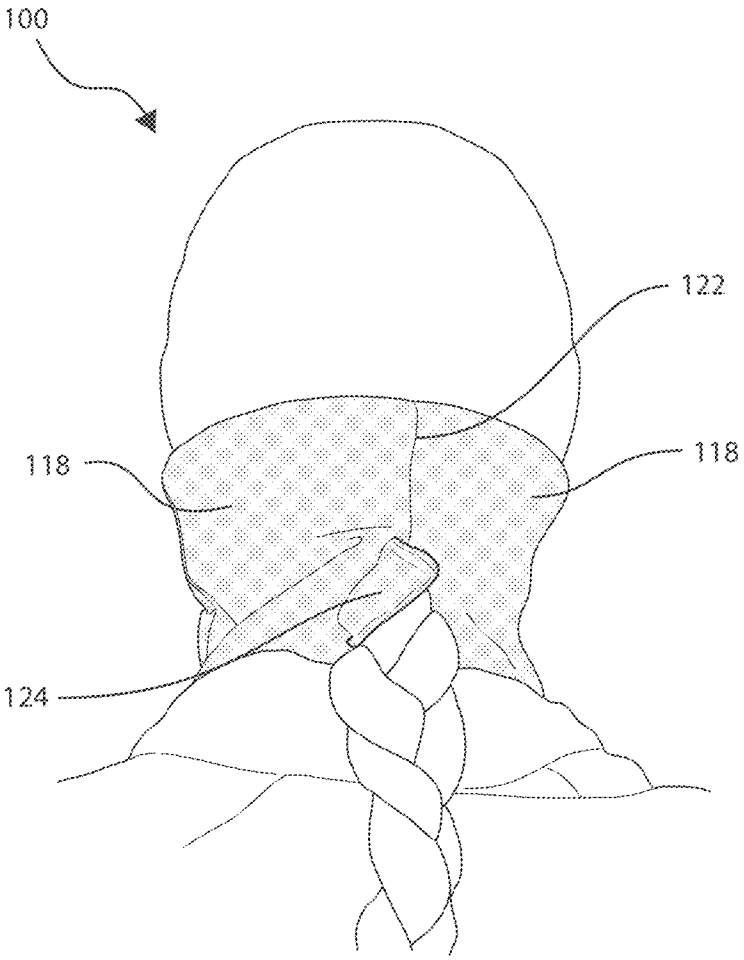
FIG. 3 is a back view illustration of a neck gaiter shown when worn according to embodiments of the disclosure.

FIGS. 1-10 illustrate an exemplary neck gaiter according to embodiments of the disclosure. FIG. 1 is a front perspective view illustration of a neck gaiter shown when worn according to embodiments of the disclosure. FIG. 2 is a side view illustration of a neck gaiter shown when worn according to embodiments of the disclosure. FIGS. 3 and 4 are back view illustrations of a neck gaiter shown when worn according to embodiments of the disclosure.

As can be seen in the Figures, the neck gaiter 100 may include a main body 102. The main body 102 has a generally cylindrical or tubular shape. The main body 102 extends between a top end 104 and bottom end 106. The top end 104 may be closer to a wearer's ears when worn, whereas a bottom end 106 may be closer to a wearer's neckline or collarbone region.

The neck gaiter 100 is configured to be received over a wearer's head and is configured to be worn over a wearer's nose and mouth when the neck gaiter 100 is worn in an operative position, as shown in FIGS. 1 and 2. The neck gaiter 100 is further configured to be located around the wearer's neck, e.g., below the user's chin, when neck gaiter 100 is worn in a non-operative position (not shown).

Figure 6:
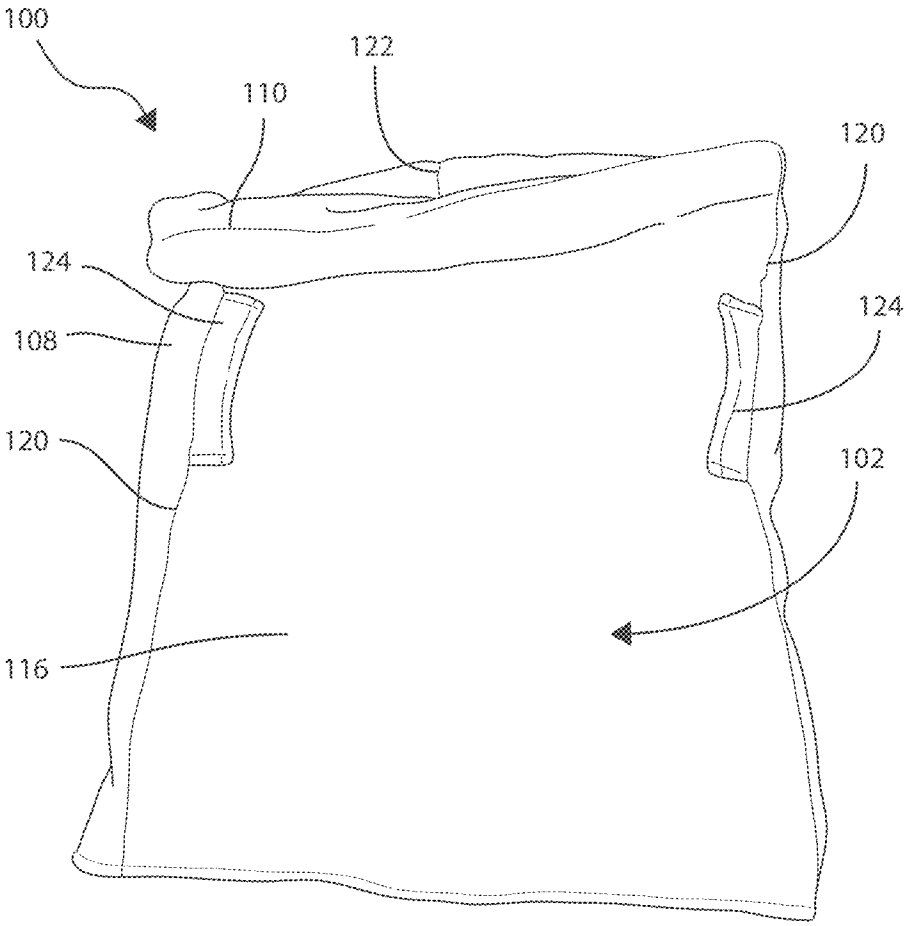
FIG. 6 is a front view illustration of a neck gaiter according to embodiments of the disclosure.

The main body 102 includes an exterior side 108 and an interior side 110. FIG. 6 shows an exemplary neck gaiter partially folded over, exposing the interior side. The interior and exterior sides 108, 110 may be formed from the same or different materials. To this end, the main body 102 of the neck gaiter 100 may include a plurality of layers. For instance, the main body 102 may include at least two layers. A first layer may be formed from a blend of polyester and spandex materials. A first layer may be an exterior layer. A second layer may be formed from a fleece or fleece-like material. A second layer may be an interior layer. The interior layer may be in contact with a wearer's body when the neck gaiter 100 is worn. Alternatively, first and second layers may both be formed from a blend of polyester and spandex materials. Neck gaiters according to embodiments of the disclosure may be formed from other materials (e.g., rayon, cotton, nylon, wool, blended materials, etc.), and materials may be modified as desired or to suit different seasons, climates, environments, etc. Additional insulative, protective, or comfort layer may be added over an interior and exterior layer, or between the layers.

The materials used to form at least a portion of the main body (i.e., an external layer) may be lightweight, breathable, insulating, wind resistant, UV protective, and the like. The materials may be sufficiently stretchable to snugly fit over the wearer's neck. The neck gaiter 100 is also sufficiently large and elastic to comfortably cover the cars, nose, and mouth if desired by the user. To this end, the main body 102 may be approximately 10-12 inches long by 9-11 inches wide. An example neck gaiter may be 11 in by 9 in. Other suitable lengths and widths are contemplated.

The elasticity of the neck gaiter 100 allows main body 102 to exert a force against the wearer's face. The elasticity allows the main body 102 to stretch so that the main body 102 can be received over a wearer's head, and to recover to substantially its original size, for example, when positioned in a non-operative position (i.e., when the neck gaiter 100 fabric is positioned below the chin and substantially around the wearer's neck). The elasticity also allows the main body 102 to be stretched into and maintain an operative position (i.e., over a wearer's nose and mouth) from a non-operative position.

Figure 5:
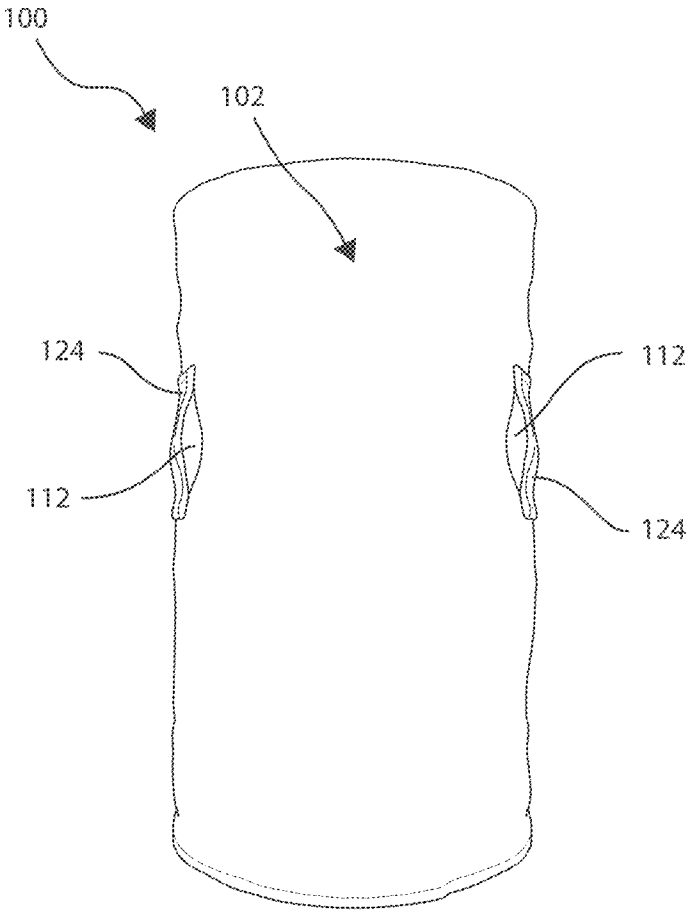
FIG. 5 is a front view illustration of a neck gaiter according to embodiments of the disclosure.
Figure 8:
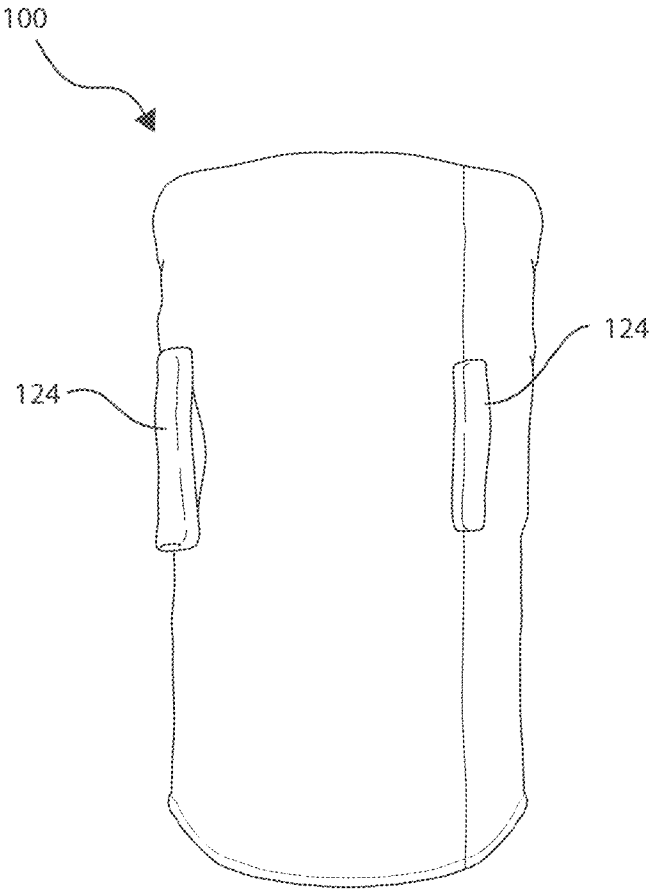
FIG. 8 is a front view illustration of a neck gaiter according to embodiments of the disclosure.

The neck gaiter 100 may include a plurality of openings formed within the main body 102. FIGS. 4 and 5 illustrate an example of a plurality of openings formed within the main body 102. In one embodiment, the main body 102 includes at least three openings. The openings may include two side openings 112, and a back opening 114. One or more of the side openings 112 may be positioned to the right of an imaginary line L positioned through a back center region of the gaiter (see, e.g., FIG. 4) (hereinafter referred to as the back center of the gaiter). One or more of the side openings 112 may be positioned to the left of the back center. The back opening 114 may be positioned to align generally vertically with the back center, and generally horizontally with a region of the wearer corresponding with the center of the nape of the neck when worn. Right and left side openings 112 may be generally equidistant from the back center opening. Right and left side openings 112 may be approximately 5-7 inches from the center opening.

The side and back openings 112, 114 may be configured to receive one or more portions of a wearer's hair. In an exemplary embodiment, the openings 112, 114 may be substantially oblong slits formed in the main body 102, and may be approximately 2-3 inches in length.

Figure 9:
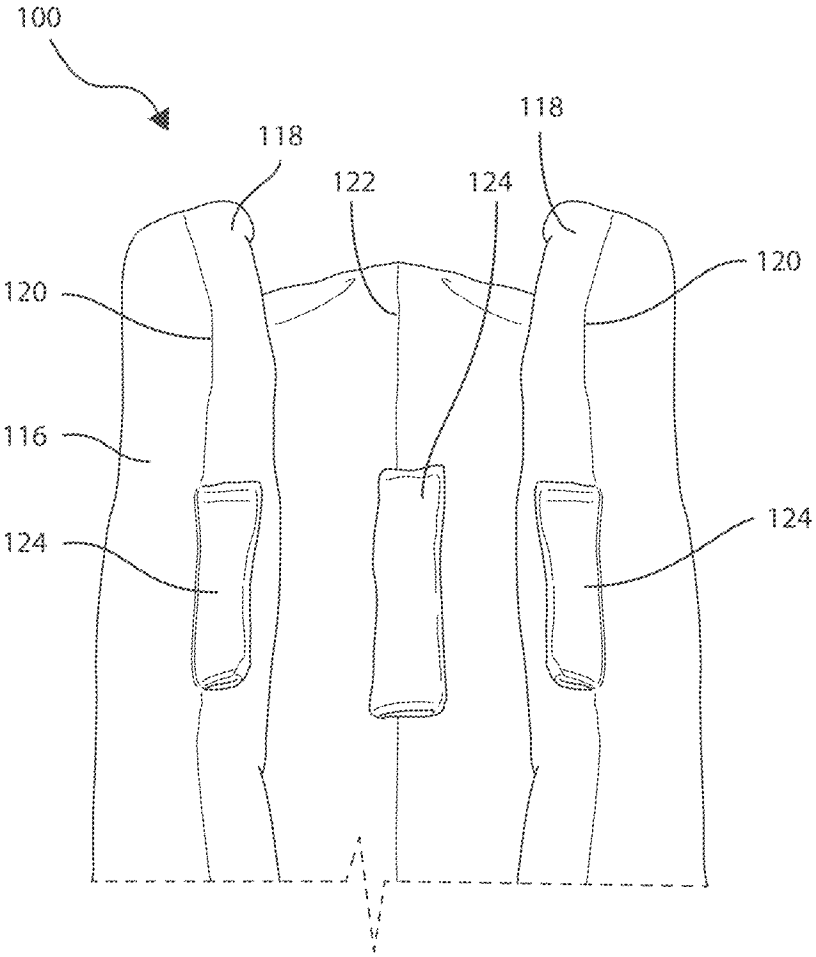
FIG. 9 is a front view illustration of a neck gaiter according to embodiments of the disclosure.

The openings 112, 114 may be sewn into one or more seams of the main body 102. To this end, the main body 102 may include a plurality of panels joined at seams to create a tubular shape. FIG. 9 illustrates the panels and seams of an exemplary neck gaiter. In some embodiments, the gaiter 100 is configured as a three-paneled article (e.g., three separate pieces of material sewn together to form a tube). The panels may include a front panel 116, and first and second side panels 118. The front panel 116 may be roughly twice as long as the side panels 118. In this configuration, each side panel 118 may join the front panel 116 at a scam 120 positioned substantially in alignment with an car of a wearer. The two side panels 118 may be joined along a scam 122 corresponding with the back center of the gaiter.

The openings 112, 114 may be formed along corresponding seams 120, 122 at locations roughly one third to one half the vertical distance from the top 104 of the main body 102. The positioning of the openings 112, 114 is such that a portion of the wearer's hair, when braided or put in a ponytail, and inserted through an opening, is secured between the wearer's body and the neck gaiter. For instance, the starting point of a braid or ponytail may be secured under the neck gaiter, to further discourage movement of the hair when the wearer is in motion.

In embodiments, the main body 102 may further include a flap 124 covering each of the openings 108, 110. Each flap 124 is partially secured to the main body 102 and covers one of the plurality of openings. The flaps 124 may be partially secured to an exterior or outer layer of the main body 102 such that the flap remains open on at least one side to enable a wearer to insert a braid or ponytail through the opening and the flap. Once a portion of a wearer's hair has been inserted into an opening, a corresponding flap is configured to secure the received portion of hair against a portion of a wearer's body. The flap 124 may also be configured to substantially prevent wind from entering the main body through a respective opening.

Figure 7:
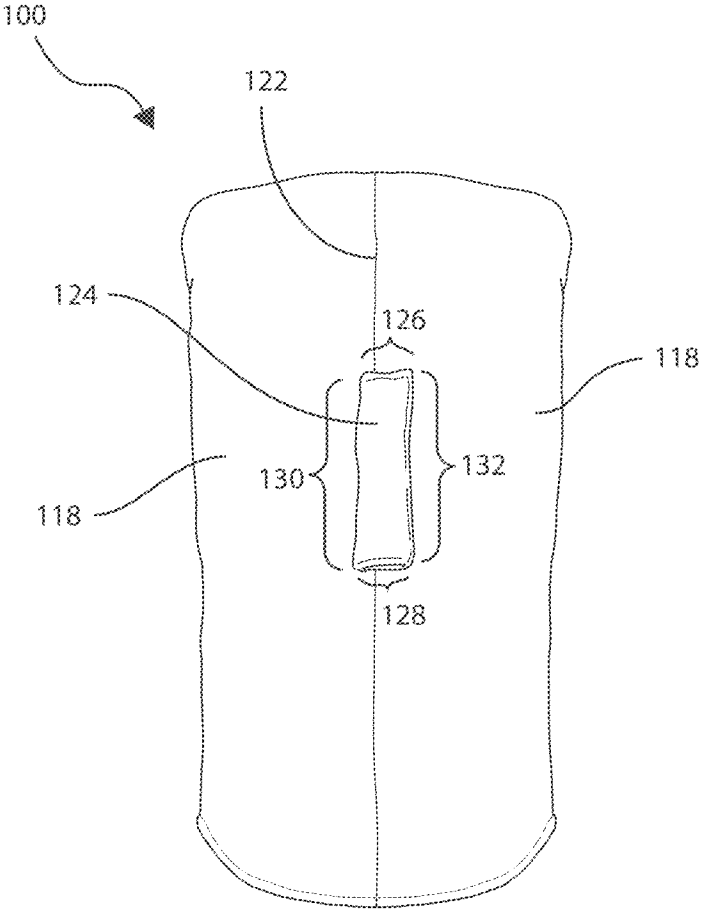
FIG. 7 is a front view illustration of a neck gaiter according to embodiments of the disclosure.
Figure 10:
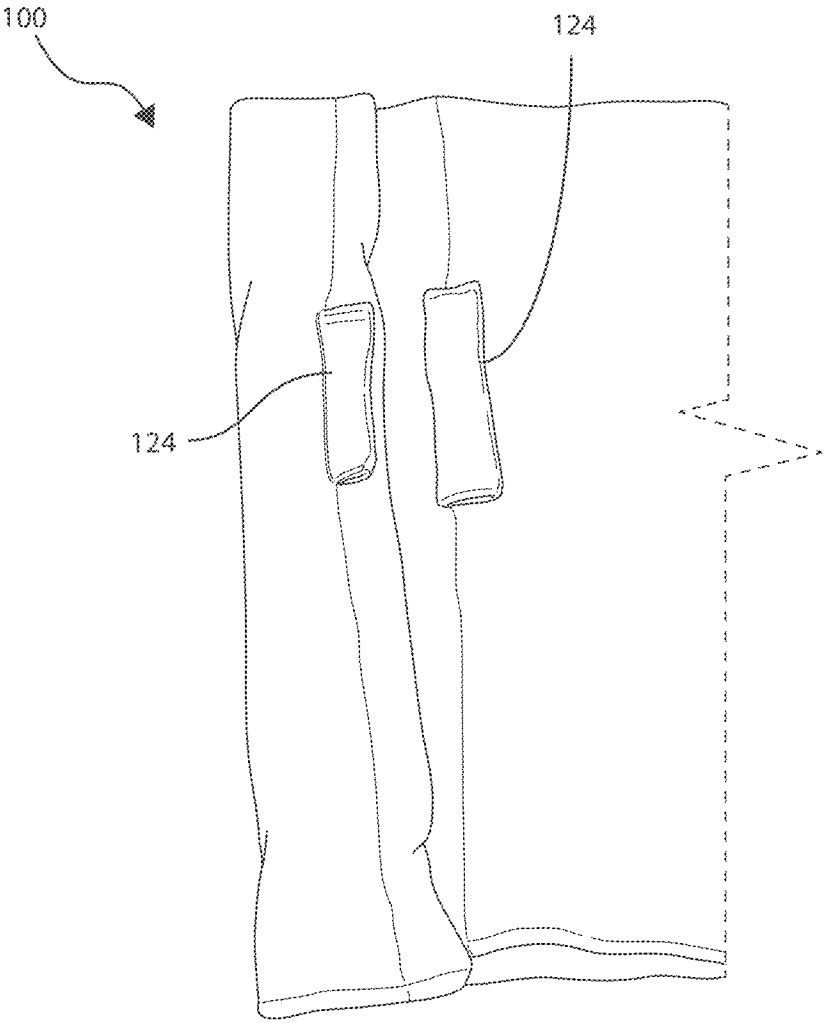
FIG. 10 is a front view illustration of a neck gaiter according to embodiments of the disclosure.

In some embodiments, the one or more flaps 124 may be secured by attaching (e.g., using a sewing stitch such as a bar tack sewing stitch) the top and bottom portions 126, 128 (as seen in FIG. 7) of the flap 124 to the main body of the gaiter. A first lateral edge portion 130 (as seen in FIG. 7) of the flap 124 may also be attached to or integrated with the main body 102. The first lateral edge 130 may be secured to the main body 102 by integrating the first lateral edge 130 into a main body panel seam (e.g., a seam that runs from the top to the bottom of the main body) and connects two panels of the main body 102. For instance, the flap 124 may be integrated into a seam 120 that joins a front main body panel 116 to an adjacent side main body panel 118. Other securing means (e.g., tape or other adhesive, fabric welding, hook and loop material, etc.) are contemplated. A second lateral edge 132 (as seen in FIG. 7) may remain open to enable a portion of the wearer's hair to be inserted through the flap.

In some embodiments, with respect to one or more of the side openings, the one or more flaps 124 integrated with the side seams 120 may be configured to face away from the back vertical centerline of the gaiter. Specifically, these flaps may be configured for side entry of a portion of a wearer's hair such that, when a user inserts a ponytail, braid or other hair portion through the opening and flap, the hair is inserted substantially vertically. The side seam flaps 124 are also configured to urge the hair in a direction down and away from a back region of the wearer. This helps the hair stay in place when the wearer is facing head-on wind. Thus, when the hair has been inserted to the desired length, the ponytail or braid may curve down and around toward a shoulder area of the wearer. The flap 124 located at the back center of the main body 102 may face either direction.

The flaps 124 may be formed from a polyester/blend spandex fabric. In alternative embodiments, an inner surface of the flap may include an attachment mechanism (e.g., a snap or hook and loop fabric) to enable closure of the flap when not in use.

The user of a gaiter as described herein may utilize one or more openings to support a variety of long hairstyles, e.g., two pigtail braids, ponytails, side braids and a long back braid or ponytail, etc. The gaiter may be a pull-over style gaiter, where the user of the gaiter would put on the gaiter by pulling it down over their head. The user may then pull an end of portion of secured hair (e.g., braid or ponytail) through the opening, and then snug the opening and the flap close to their head to substantially seal the opening and prevent wind from penetrating the gaiter at the openings.

Methods of forming a neck gaiter are contemplated. Methods may include forming a neck gaiter including one or more of the components as described herein.

The accompanying Figures illustrate the structure, functionality, and operation of possible implementations of the apparatus, and methods of making and using the apparatus, according to various embodiments of the present invention. Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

From the above description, it can be seen that the present invention provides an apparatus and methods of making and using the apparatus. References in the claims to an element in the singular are not intended to mean "one and only" unless explicitly so stated, but rather "one or more." All structural and functional equivalents to the elements of the above-described exemplary embodiment that are currently known or later come to be known to those of ordinary skill in the art are intended to be encompassed by the present claims. No claim element herein is to be construed under the provisions of 35 U.S.C. section 112, sixth paragraph, unless the element is expressly recited using the phrase "means for" or "step for."

While the foregoing written description of the invention enables one of ordinary skill to make and use what is considered presently to be the best mode thereof, those of ordinary skill will understand and appreciate the existence of alternatives, adaptations, variations, combinations, and equivalents of the specific embodiment, method, and examples herein. Those skilled in the art will appreciate that the within disclosures are exemplary only and that various modifications may be made within the scope of the present invention. In addition, while a particular feature of the teachings may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising."

Other embodiments of the teachings will be apparent to those skilled in the art from consideration of the specification and practice of the teachings disclosed herein. The invention should therefore not be limited by the described embodiment, method, and examples, but by all embodiments and methods within the scope and spirit of the invention. Accordingly, the present invention is not limited to the specific embodiments as illustrated herein, but is only limited by the following claims.

What is claimed:

1. A neck gaiter, comprising:

a main body having a generally cylindrical shape;

a plurality of openings within the main body, wherein the plurality of openings include at least two side openings and at least one back opening; and a plurality of flaps, wherein each of the plurality of flaps is partially secured to the main body along three lateral edges of a respective flap over each of the plurality of openings, wherein each of the plurality of openings is configured to receive a portion of a user's hair, the plurality of flaps including at least two side opening flaps covering the at least two side openings, and a back flap covering the at least one back opening, wherein each of the plurality of flaps is a vertically aligned elongate flap configured to secure the received portion of the user's hair against a portion of a user's body and substantially prevent wind from entering the main body through a respective opening, and wherein the at least two side opening flaps partially secured over the at least two side openings are configured to face away from a back vertical centerline of the main body, such that the at least two side opening flaps may be configured to urge the received user's hair in a direction down and away from a back region of the user wherein a fourth lateral edge of each respective flap is configured to remain open to enable a portion of the user's hair to be inserted through the respective flap, wherein the fourth lateral edge is farther from the back vertical centerline than one of the three lateral edges.

2. The neck gaiter of claim 1, wherein the main body comprises a front panel and first and second side panels.

3. The neck gaiter of claim 2, wherein the front panel is joined to the first side panel via a first seam.

4. The neck gaiter of claim 3, wherein the front panel is joined to the second side panel via a second seam.

5. The neck gaiter of claim 4, wherein the first side panel is joined to the second side panel via a third seam.

6. The neck gaiter of claim 5, wherein at least one opening of the plurality of openings is formed along at least one of the first seam, the second seam, or the third seam.

7. The neck gaiter of claim 1, wherein the main body comprises a plurality of layers.

8. The neck gaiter of claim 7, wherein each of the plurality of layers is formed from a different material.

9. A method of manufacturing the neck gaiter of claim 1.

* * * * *